US006086002A

United States Patent [19]

Frazier et al.

[11] Patent Number: 6,086,002

[45] Date of Patent: Jul. 11, 2000

[54] BALANCED COMMINUTING, VACUUM AND LOADING AND/OR SPREADING SYSTEM

[76] Inventors: Joan H. Frazier; Glenn L. Frazier, both of 15501 Little Valley Rd., Grass Valley, Calif. 95949-6873

[21] Appl. No.: 09/337,638

[22] Filed: Jun. 21, 1999

Related U.S. Application Data

[60] Provisional application No. 60/090,594, Jun. 25, 1998.

[51] Int. Cl.[7] ..... B02C 21/02; B02C 23/08

[52] U.S. Cl. ..... 241/47; 241/69; 241/79.1; 241/101.76; 241/186.3; 241/189.1

[58] Field of Search ..... 241/47, 69, 79, 241/79.1, 101.76, 189.1, DIG. 38, 186.3

[56] References Cited

U.S. PATENT DOCUMENTS

| | | | |
|---|---|---|---|
| Re. 33,840 | 3/1992 | Peterson et al. | 241/101.76 X |
| 5,205,496 | 4/1993 | O'Donnell et al. | 241/34 |
| 5,226,757 | 7/1993 | Tarrant | 241/DIG. 38 X |
| 5,454,521 | 10/1995 | Frazier et al. | 241/51 |

*Primary Examiner*—John M. Husar
*Attorney, Agent, or Firm*—Harold D. Messner

[57] ABSTRACT

The present invention relates to a hydraulic assisted comminuting, vacuuming and loading system for debris and includes: a self propelled vehicle having a bed for either (i) feeding native material, commercial mulch and the like into the system, or (ii) receiving debris from the system after comminution has occurred in a in-line fashion; a frame trailerable attached to an end of the self propelled vehicle and including ground engaging wheels; a comminuting chamber attached to the frame at one end having a plurality of side walls upwardly depending from the frame, input and output openings, a hammermill having a shaft extending across the chamber, a first hydraulic motor assembly attached at one end of the shaft including input and output hoses and a first controller, a series of bifurcated hammers and a grate through which the comminuted material passes; an air fan chamber attached to the frame having an input opening connected to the output opening of the comminuting chamber, an output opening, a fan positioned within the chamber including a flywheel having a shaft, a second hydraulic motor attached to the shaft and including input and output hoses and a second controller; a hydrocarbon sourced engine, mounted to the frame having a drive shaft rotating in a range of 1800 to 3000 rpm, a hydraulic pump attached to the drive shaft providing hydraulic sourcing of the first and second hydraulic motors to provide rotation of the hammermill and the fan at sufficient rates to drive material at a flow rate Q through both the comminuting and air vacuum generating chambers.

17 Claims, 8 Drawing Sheets

BALANCED COMMINUTING, VACUUM AND LOADING AND/OR SPREADING SYSTEM

This application claims benefit of Provisional application Ser. No. 60/090,594, filed Jun. 25, 1998.

SCOPE OF THE INVENTION

The present invention relates to a leaf, lawn and garden debris loading and/or spreading system, especially for revegetation and erosion control in combination with ultra-long dispersal capability and more particularly to a portable, single-traffic lane system that vacuums, comminutes and loads and/or spreads debris and landscape materials at a surprisingly high but variable flow rate between shredder and dispersing fan with the capability of ultra-long spreading of the materials say up to 50 feet directly from a dispersal nozzle attached to the fan outlet chute and say up to 500 feet using an auxiliary lightweight hose attached directly to the fan outlet chute.

BACKGROUND OF THE INVENTION

The prior art is replete with apparatuses for vacuuming and pulverizing leaf, lawn and garden debris. Usually these devices relate to motor-driven shredders of relatively low flow rates. Recently, federal, state and local officials have seen the need to disperse landscaping including native materials—at relative high flow rates—onto hillsides adjoining roadways to prevent erosion. For example, the city of Berkeley, Calif. contracts to have wooden chips cast on its hillsides. Similarly, in order to reduce nutrient intake to Lake Tahoe in the western U.S., a program of spreading of forest duff including pine needles, is being planned. Experience has shown that there are no present apparatuses available that have the flexibility for multi-operations in the following circumstances: (i) to vacuum, comminuted and load debris at a surprisingly high but variable flow rate between hammermill or shredder (also called "comminuting chamber") and the dispersing fan in a shredding and capture mode wherein the debris is loaded onto the bed of in-line truck attached to the front of the apparatus of the invention that also causes movement of the latter, (ii) to spread native and/or landscaping materials either captured on-site, viz., at the dispersal site or trucked-in, to adjacent hillside locations from a single-lane of a roadway in which enhancement of the material and dispersal direct on are variable, (iii) to spread native or commercial landscaping materials carried on the bed of an in-line truck attached to the rear of the apparatus of the invention in-line with the system of the invention and providing locomotion to the latter, the flow of the native or commercial materials being either through the hammermill of the invention for enhancement purposes or directly to the inlet of the fan chamber with the additional capability of the fan to direct dispersal of the native or commercial landscape materials in a variety of directions say up to 50 feet directly from a dispersal nozzle attached to the fan outlet chute and to spread the latter material, say up to 500 feet using an auxiliary hose attached directly to such fan outlet chute.

In our prior patent, U.S. Pat. No. 5,454,521, we set forth a system which the speeds of the hammermill and fan were directly related to the speed of an engine, shafts of the former being directly connected via sheaves and belts to the shaft of the engine. Increasing the speed of the engine, proportionally increases the speed of operations of the hammermill and fan in a constant proportion. We have now discovered that if the speeds of the hammermill and fan are independently variable with respect to each other and driven by separately controllable hydraulic motors connected to a hydraulic pump driven by the engine, flexible operations are provided in the following circumstances: (i) to vacuum, comminute and load debris at a surprisingly high but variable flow rate between hammermill or shredder and the dispersing fan in a shredding and capture mode wherein the debris is loaded onto the bed of in-line truck attached to the front of the apparatus of the invention that also causes movement of the latter, (ii) to blow native materials such as duff from forest floors, straw, pine needles, chipper chips (chucks of wood processed by chipper (bladed apparatus) captured on-site or trucked-in and enhanced by the hammermill, to adjacent hillside locations from a single-line of a roadway in which enhancement of the material and dispersal direction is variable, (iii) to blow native or commercial mulch carried on the bed of an in-line truck attached to the rear of the apparatus of the invention and providing locomotion to the latter, the flow of the native or commercial mulch being either through a chute into the hammermill for enhancement purposes or directly to the inlet of the fan with the additional capability of the fan to direct dispersal of the native or commercial mulch in variety of directions say up to 50 feet directly from a dispersal nozzle attached to the fan outlet chute and say up to 500 feet using an auxiliary hose attached directly to such outlet chute.

SUMMARY OF THE INVENTION

The prevent invention relates to a hydraulic assisted comminuting, vacuuming and loading and/or spreading system for debris. In the invention, the debris can contain small rocks up to 3 inches in diameter, be lawn clippings, leaves, plants and the like, native materials such as duff from forest floors, straw, pine needles, chipper chips (chucks of wood processed by chipper (bladed apparatus) captured on-site or trucked-in, commercial landscaping materials including mulch, compost, fertilizer and the like that can be wetted to a slight degree. The system of the invention includes:

- a rubber wheeled, self propelled vehicle in contact with the earth's surface to establish a datum line and including a bed having the capability for either (i) feeding native material including forest duff, landscaping materials including commercial mulch, wooden bark, wood rounds or yard waste into the system from the rear of the system and providing locomotion of the latter, or (ii) receiving enhanced (processed) debris from the system unto its bed of such vehicle positioned at a forward position, after comminution has occurred;
- a frame trailerable attached to an end of the self propelled vehicle adjacent to the bed thereof to provide single-lane operations and including ground engaging wheels defining the datum line;
- a comminuting chamber attached to the frame at one end thereof having a plurality of side walls upwardly depending from the frame, sets of independently servicing input openings for inputting debris and/or other types of materials interior of the comminuting chamber and an output opening through the back wall for outputting comminuted debris and/or other types of materials wherein the chamber including a hammermill comprising disc means located within the side walls having a shaft extending across the chamber, a first hydraulic motor attached at one end of the shaft, input and output hoses attached to the motor through a first controller, a series of bifurcated hammers attached to the disc means and movable therewith, and a disconnectable connected grate at the periphery of the disc means through which the comminuted material passes;

an air fan chamber attached to the frame having an input opening attached to the output opening of the comminuting chamber in air vacuuming communication therewith in a first mode of operation, and an output opening horizontally positioned at a position above the datum line, a fan positioned within the chamber including a flywheel having a shaft, a second hydraulic motor attached at one end of the shaft, input and output hoses connected to the second hydraulic motor through a second controller, and a series of blades attached to the flywheel and movable therewith, a hydrocarbon or propane (LP) sourced engine, mounted to the frame having a drive shaft rotating in a range of 1800 to 3000 rpm, a hydraulic pump attached to the drive shaft of the engine and providing hydraulic sourcing of the input hoses of the first and second hydraulic motors to provide rotation of the hammermill and the fan positioned within the comminuting and air fan chambers, respectively, of sufficient speed to drive material at a flow rate Q through both the comminuting and air vacuum generating chambers, thence from the air fan chamber at a surprising high rate.

DETAILED DESCRIPTION OF THE INVENTION

Figures 1, 2, 3, 3A:
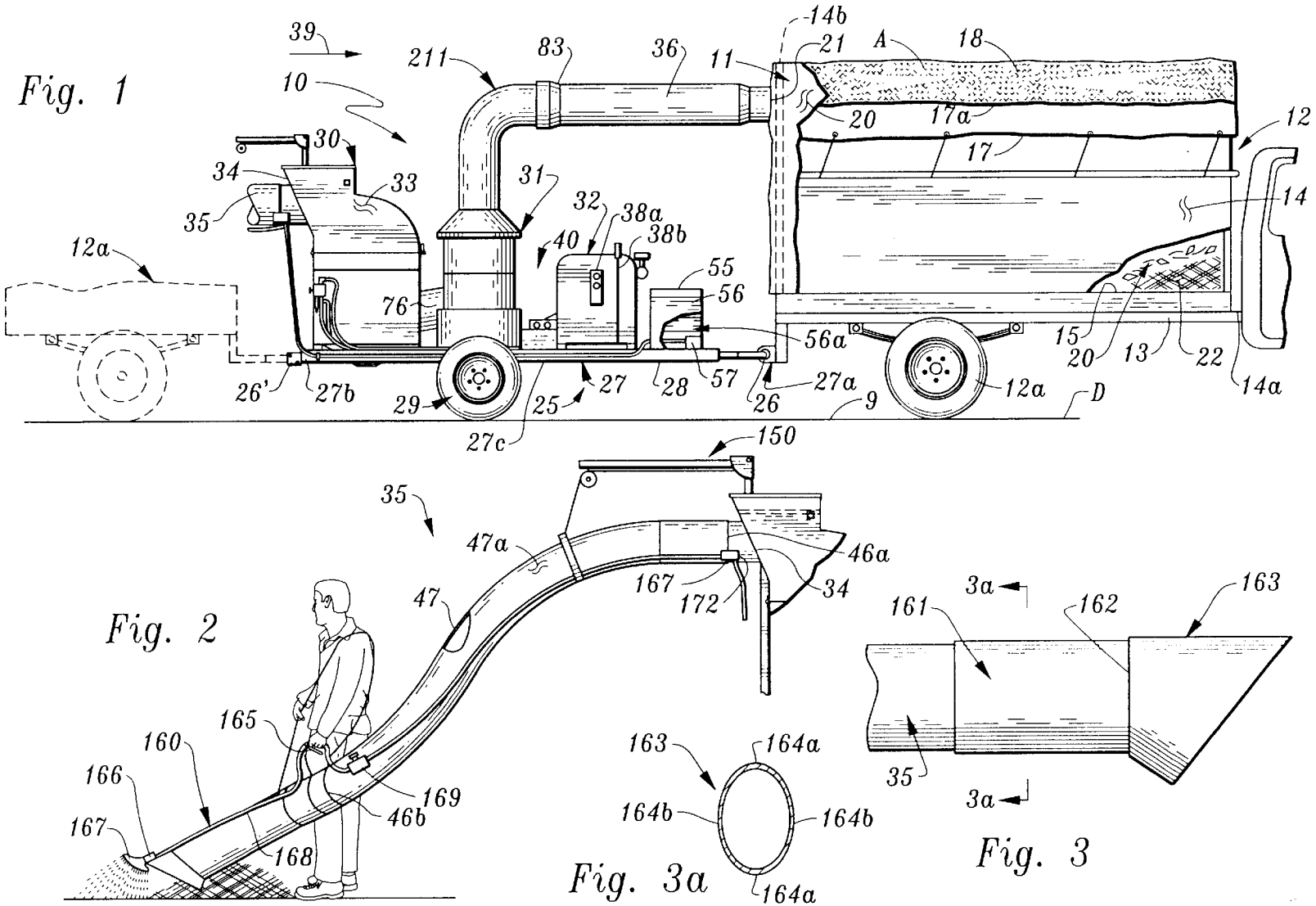
FIG. 1 is a side view of the system of the invention depicting the difference modes of operation including a self-propelled vehicle in solid line attached to a frame at a forward position and a second self-propelled vehicle in phantom line attached at the rear of the frame, the frame including an independently controllable comminuting chamber and an independently controllable air fan chamber driven into operations via hydraulic pump-hydraulic motor system driven by a diesel, propane or gasoline sourced engine carried on the frame wherein (i) in the first mode the output end of high pressure hose delivers comminuted material to the enclosed bed of the vehicle and (ii) in the second mode, the input end of the low pressure vacuum hose shown in phantom line is attached either to one of a set of input ports of the comminuting chamber or directly to the input port of the fan for spreading material to locations between ten and 500 feet from the vehicle.
FIG. 2 is partial side view of the vacuum hose of the FIG. 1 showing a user sweeping up debris from the earth's surface while wetting same using a water-carrying conduit in association with a directional snout supported by a boom assembly.
FIG. 3 is a detail side view of the snout of FIG. 1.
FIG. 3*a* is a section taken along line 3*a*—3*a* of FIG. 3.

Referring to FIG. 1, a comminuting, vacuuming and loading system 10 is shown. The purpose of system 10: to shred, vacuum and unload and/or spread debris or other types of materials as previously noted (and not shown) in separate modes of operation and includes a self-propelled vehicle 12 in a first mode in solid line attached to a frame 27 at a forward position 27*a* and in a second mode, including a second self-propelled vehicle 12' shown in phantom line attached at the rear position 27*b* of the frame 27. In both modes, the frame 27 supports an independently controllable comminuting chamber 30 and an air fan chamber 31 powered by an internal combustion engine 32 through a hydraulic pump-hydraulic motor system 40. That is to say, the air fan chamber 31 and the comminuting chamber 30 are driven into operations via hydraulic motors 41*a*, 41*b* (see FIGS. 4–7) through hydraulic pump 42 connected the engine 32 wherein separate modes of operation are defined.

(i) in the first mode high pressure hose 36 delivers comminuted debris into a canopy-type bed 11 of a self-propelled vehicle 12, such as a conventional truck having rubber-tired wheels 12*a* in contact with the earth's surface 9 defining a datum line D. The bed 11 includes a series of upright, vertical walls 14 attached at end 14*a* to floor 15. Across the other, more remote ends 14*b* of the vertical walls 14 is a cover 17. The cover 17 is formed of a plastic material having a large horizontally extending, output opening 17*a* fitted with a filter 18 of a conventional filter material such as fiberglass. Area A of the filter 18: in a range of 50 to 75 square feet to permit balanced egress of air flow from the vehicle 12, as explained below. Note in FIG. 16 that air flow within the bed 11 is controlled so that air-born debris 20 entering by way input opening 21, falls by gravity unto floor 15 of the bed 11 and forms pile 22.

Figure 9:
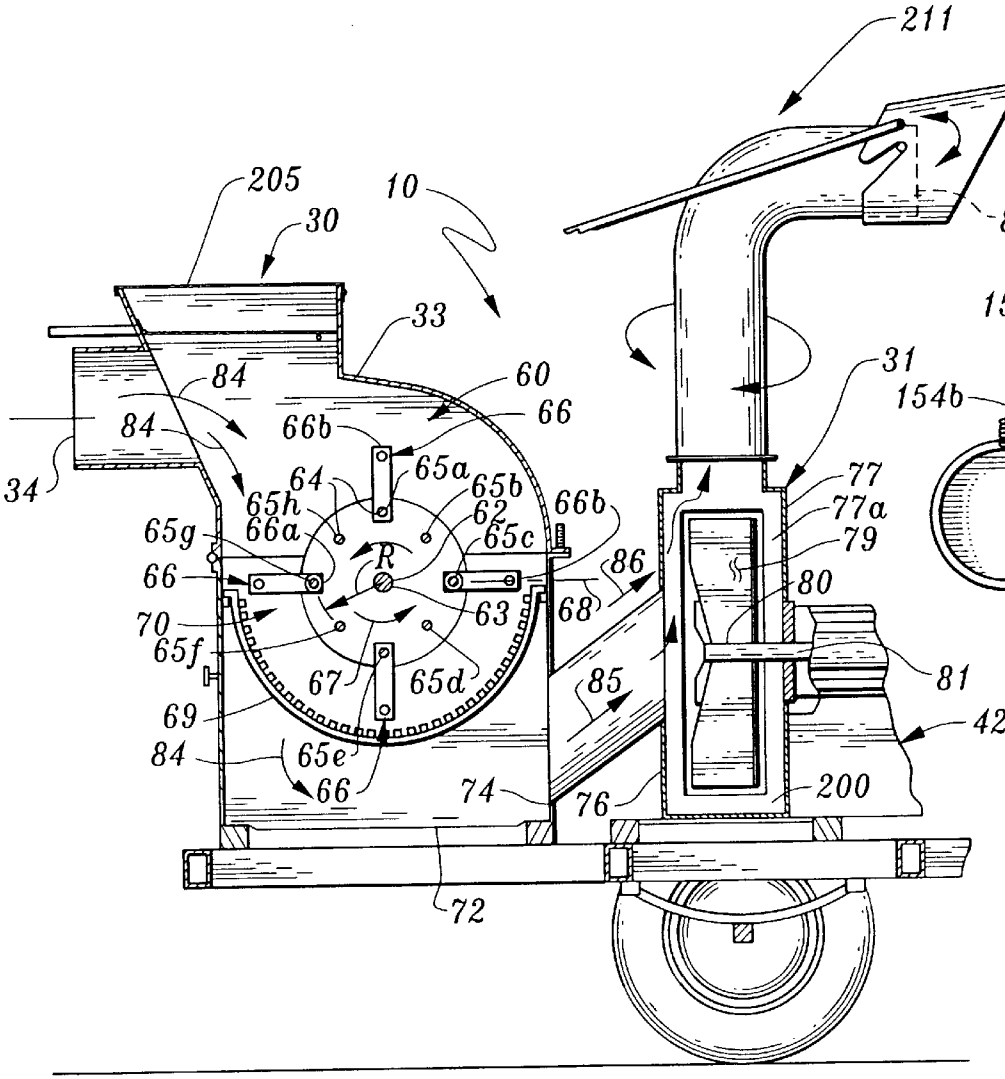
FIG. 9 is a partial side view of the system of FIG. 1 cut-away to show the comminuting and air fan chambers in more detail and in which air fan chamber is provided with a directional dispersal outlet chute for spreading materials at locations exterior of the system of FIG. 1.

(ii) In the second mode, low pressure vacuum hose 35 shown in phantom line is attached either to input port 34 of the comminuting chamber 30 or directly to the input port 76 of the air chamber 31 and thence flows out of the air chamber 31 via output port 83 (with the output hose 36 disconnected as shown in FIG. 9) thence to a dispersal outlet chute 211 for spreading material to locations adjacent to the vehicle, as explained below.

A trailer 25 including frame 27 is attached to an end strut 27*c* of either vehicle 12 or 12', via one of a pair of trailer hinges 26, 26' and includes a horizontal support 28 in engagement with the earth's surface 9 through a wheel assembly 29. Atop the horizontal support 28 are the Following separate work stations: a comminuting chamber 30 and an air fan chamber 31 powered—separately controllable—by an internal combustion engine 32 through a hydraulic pump-hydraulic motor system 40, see FIG. 4. That is to say, the air fan chamber 31 and the comminuting chamber 30 are driven into operations via hydraulic motors 41*a,* 41*b* through hydraulic pump 42 connected the engine 32 as previously mentioned, wherein separate modes of operation are defined.

The comminuting chamber 30 includes a plurality of side walls 33 upwardly depending from the horizontal support 28 and an input port 34 of circular cross section defining a horizontal axis of symmetry 34*a*. Outer surface of the input port 34 is frictionally connected to vacuuming hose 35. Other input ports are also available as explained below.

The engine 32 includes on-off controller 38*a,* and a speed controller 38*b* and translates rotational power to control various aspects of the invention as explained below.

The air vacuum chamber 31 is attached to the horizontal frame 27 of the trailer 25 over a mid-region above wheel assembly 29 and includes output hose 36 (associated with mode (I) operations only), in operations associated with vehicle 12, the air pumping chamber 31 is energized to cause air flow in the direction of arrow 39, i.e., through vacuuming hose 35, input port 34 of the comminuting chamber 30, and thence out of the air vacuum chamber 31 to the cavity bed 11 of the vehicle 12. In operations associated with vehicle 12', however, low pressure vacuum hose 35 shown in phantom line is attached either to input port 34 of the comminuting chamber 30 or directly to the input port 76 of the air chamber 31 and thence flows out of the air chamber 31 via output port 83 (with the output hose 36 disconnected) and to a dispersal chute 211 for spreading material to locations adjacent to the vehicle, as explained below.

FIG. 2 shows the vacuuming hose 35 in more detail.

As shown, the vacuuming hose 35 has a remote end 46*a* which can be attached to circular input port 34 of the comminuting chamber 30 in the mode of operations associated with vehicle 12, and a near end 46*b* and a side wall 47 defining an exterior surface 47*a*. To the near end 46*b* a snout 160 is attached, see FIG. 3. The snout 160 is sized to fit within the hose 35 at a first end section 161 of circular cross section and is swedged at junction 162 to form an oval suction section 163 (see FIG. 4) having short end surfaces 164*a* and long side surfaces 164*b*. In erosion control, the snout 160 has surprising capability to vacuum duff wherein longer—lengthwise—pine needles (say greater than the diameter of the first end section 161) can be swept through the oval section 163 thence through the first end section 161, without clogging. Adjacent to the short end surfaces 164*a* and bridging the first end and oval suction sections 161, 163, respectively, is an inverted U-shaped handle 165 by which the snout 160 can be manipulated. Adjacent to the handle 165 is a misting system 166 comprising a nozzle 167, a quick release coupler 167 and a central pipe 168 including an on-off valve 169 therein. A conventional water hose section 172 can attach to quick release coupler 167 and thence to a water tank 55 positioned on the trailer 25. The tank 55, see FIG. 1, includes a plurality of walls 56 defining a cavity 56*a* into which is positioned a stand-along, battery operated water pump 57.

Figure 4:
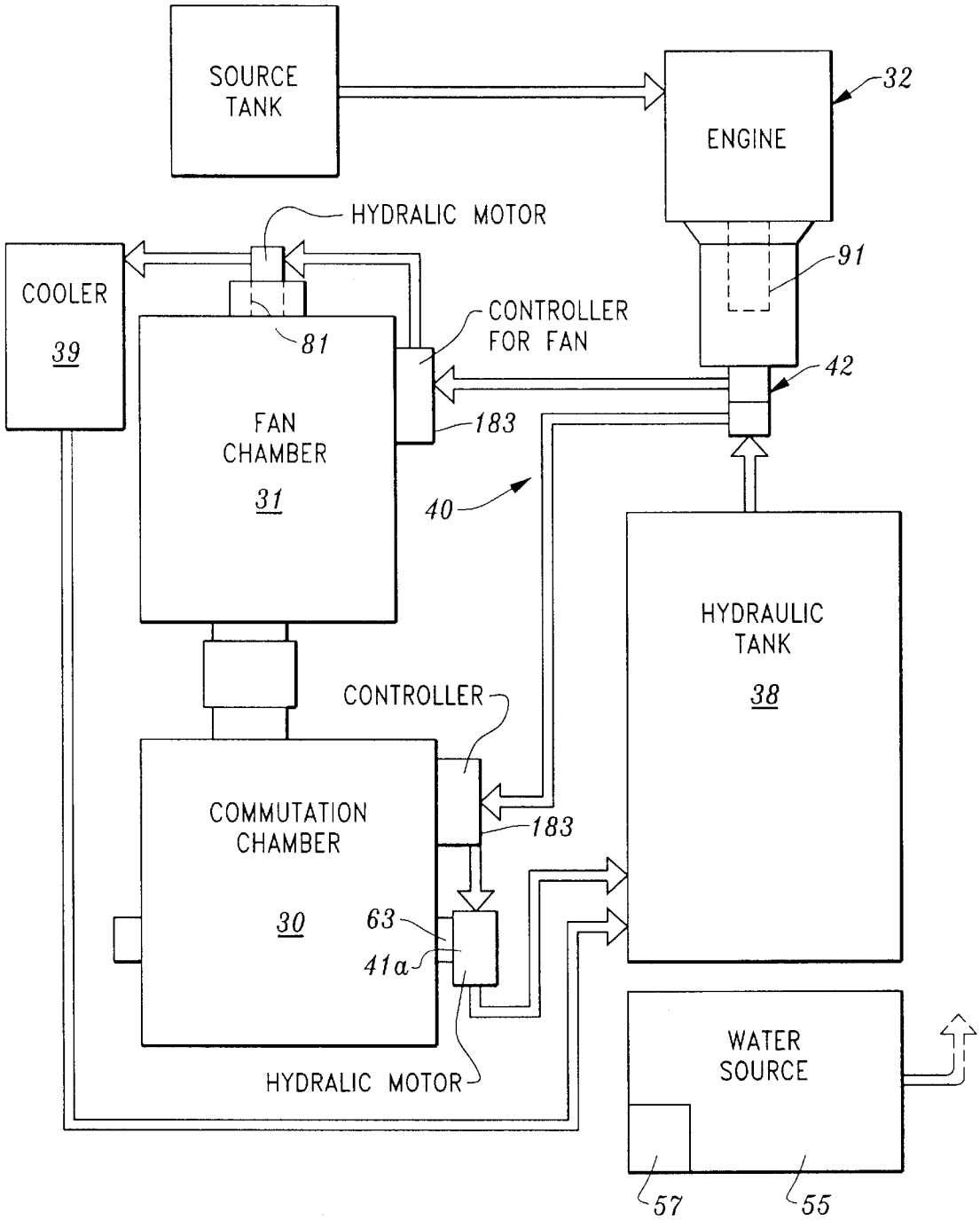
FIG. 4 is a partially schematic diagram of the hydraulic pump-hydraulic motor system of FIG. 1.
Figure 6:
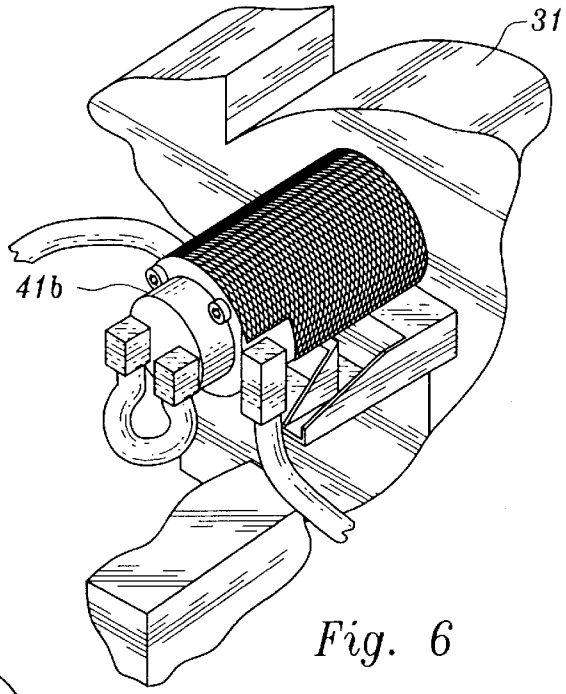
FIG. 6 is a detail perspective view of the hydraulic motor of FIG. 4 attached to the air fan chamber of FIG. 1.
Figure 5:
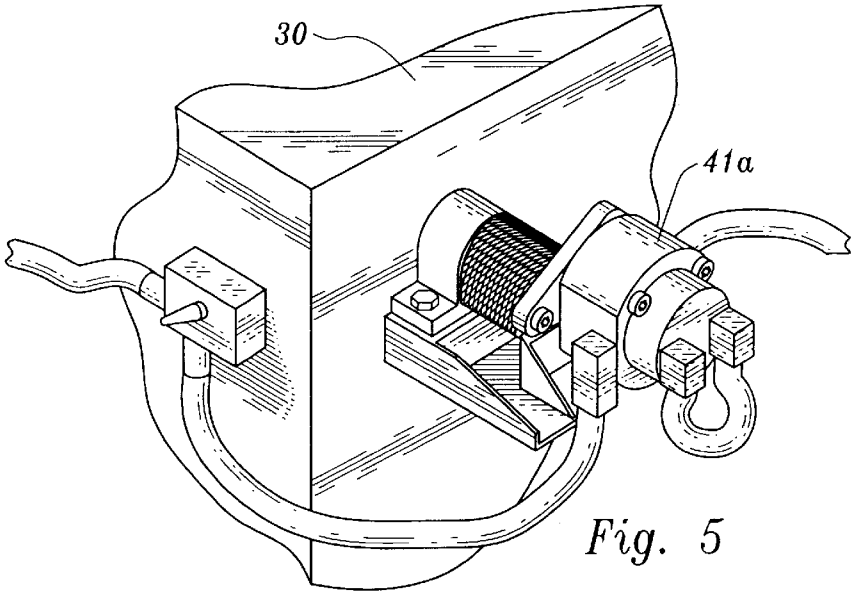
FIG. 5 is a detail perspective view of the hydraulic motor of FIG. 4 attached to the comminuting chamber of FIG. 1.
Figure 7:
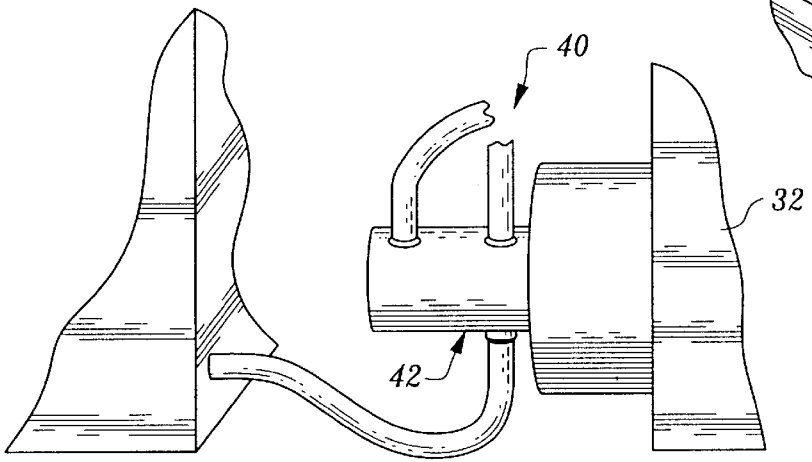
FIG. 7 is a detail perspective view of the hydraulic pump of FIG. 4 attached to the hydrocarbon sourced engine of FIG. 1.
Figure 8:
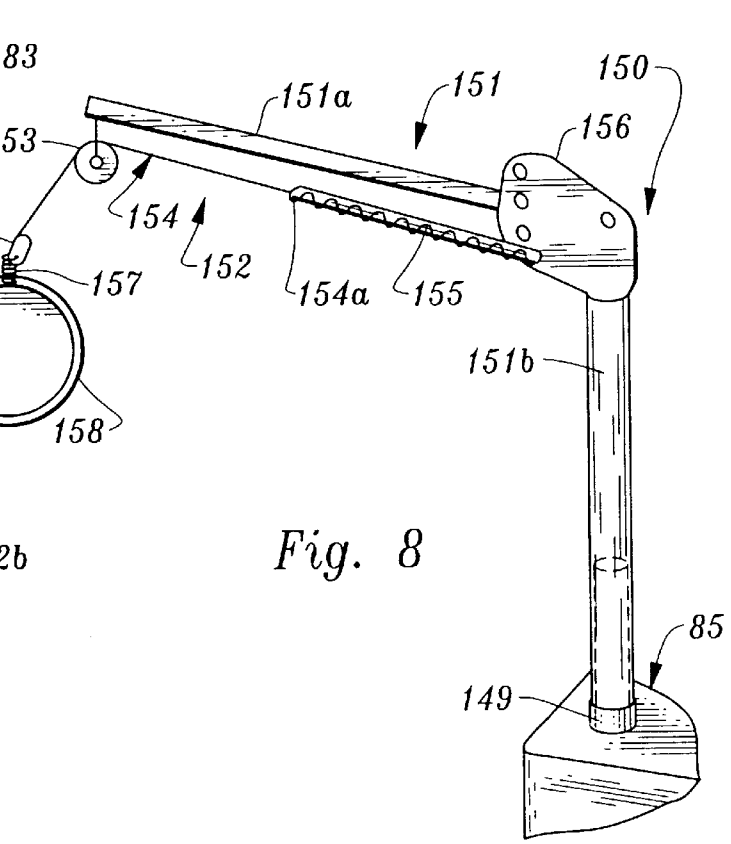
FIG. 8 is a detail side view of the boom assembly of FIG. 2.

In operation, the water pump 57 of FIG. 4 drives water through the misting system 166 of FIG. 2 to provide for wetting of the debris to usually a slight amount to limit dust generation. Note that mechanical manipulation of the snout 160 is aided by a boom assembly 150, see FIGS. 2 and 3, pivotally attached to the trailer 25 that includes a L-shaped support 151 pivotally attached to the trailer 25 at base 149 for support a pulley assembly 152 above the base 149. The pulley assembly 152 includes a pulley 153 attached to the radial arm 151*a* of the L-shaped support 151, the pulley 153 supporting a belt 154 having one end 154*a* attached to a compression spring 155 fixed to a central hub 156 at the intersection of the radial arm 151*a* and an upright arm 151*b,* and another end 154*b* attached via a quick release swivel 157 to ring support 158 through which the vacuuming hose 35 extends, see FIG. 2. In operations, the L-shaped support 151 is off set to one side of the trailer 25 so that the hose 35 exiting from the comminuting chamber 30 is formed into a gentle curving section that remains more or less horizontal because of the ring support 158 is positioned about the same height above the earth's surface as the exit port of the comminuting chamber 30. In addition, because the L-shaped support 151 is permitted to pivot relative to the base 149 the ring support 158 can change elevation against the bias of the compression spring 155 but if the force on the hose 35 is neutralized, the ring support 158 always returns to the position shown.

FIGS. 9–15 show the comminuting and air vacuum chambers 30, 31 in detail.

Figure 11:
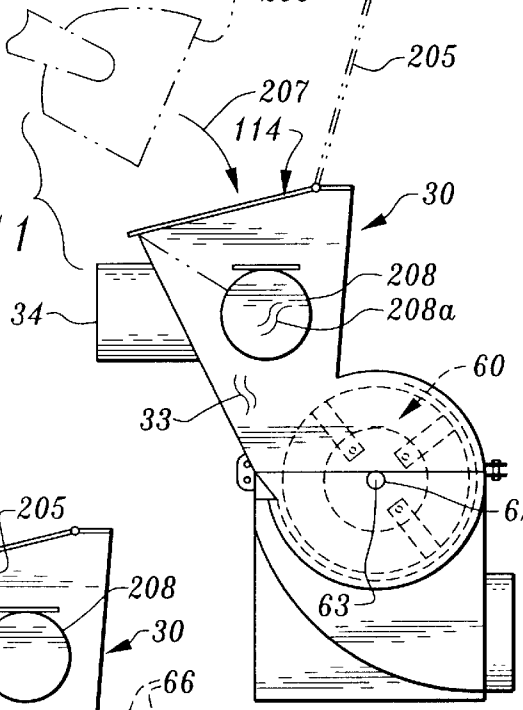
FIG. 11 is another detail side view of the comminuting chamber of FIG. 9 in which a lid is shown in an open position to receive materials via a loading bucket of a conventional loader.
Figure 10:
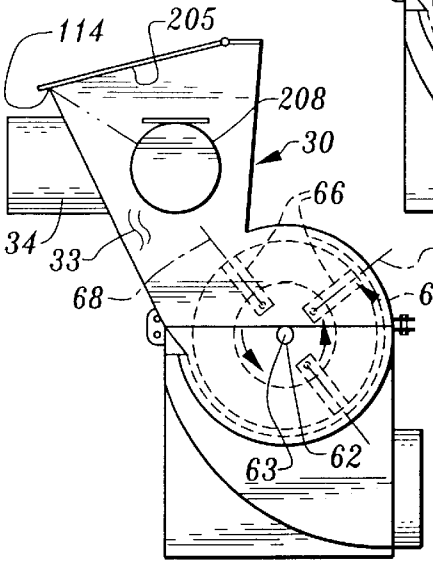
FIG. 10 is a detail side view of the comminuting chamber of FIG. 9 showing the interior shredding assembly and the fan blades in phantom line.
Figure 14:
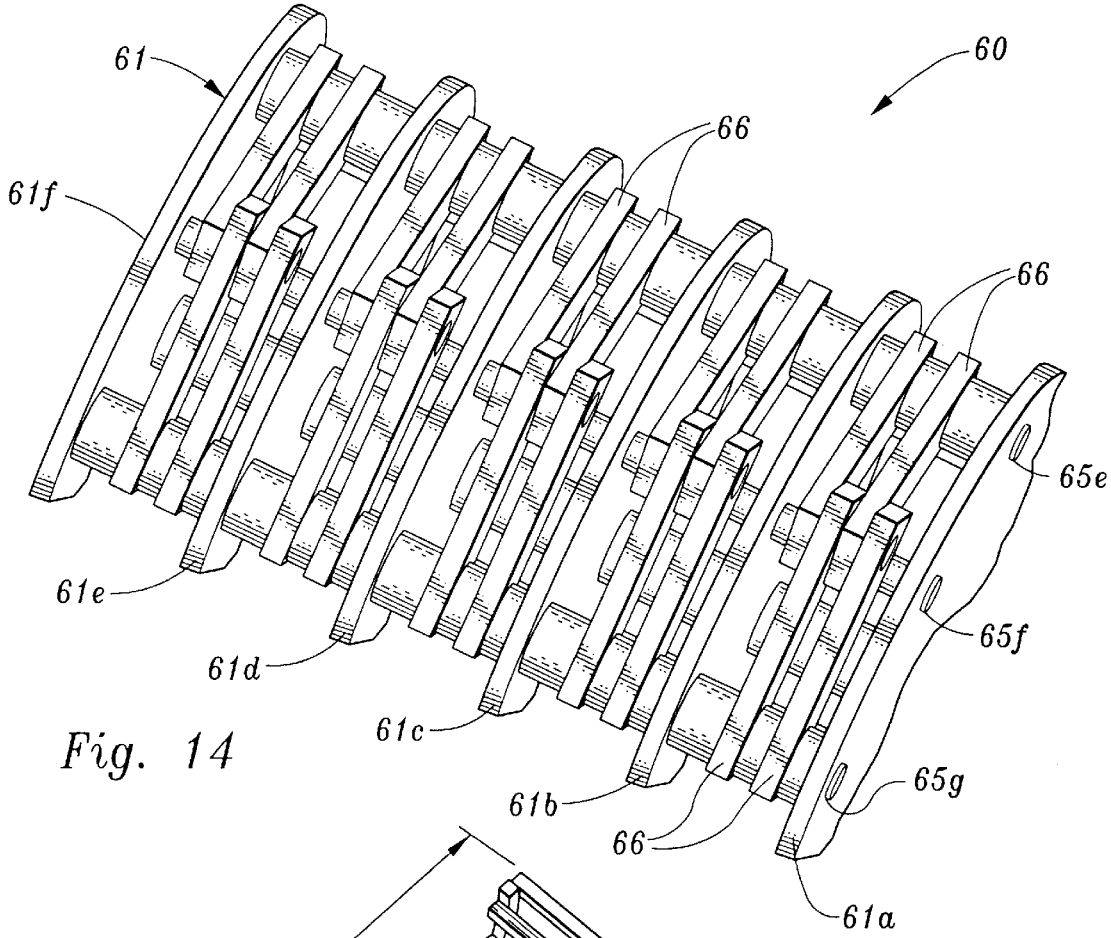
FIG. 14 is a detail perspective view of the hammer subassembly of the shredding assembly of FIGS. 9 and 10.

As shown in FIGS. 9–15, the comminuting chamber 30 includes an interior shredding assembly 60 positioned interior of the walls 33 about midregion thereof, well below the input port 34 at the upper section of the chamber 30, the input port 34 of course being one of three as explained below, see FIGS. 10 and 11, in this regard note in FIGS. 10 and 11 that another port is associated with the upper termination surfaces of walls 33 at hinged top section 205 to define input port 114 when the top section 205 is opened. That is to say, with the top section 205 pivoted away from contact with walls, direct entry of material is easily achieved as in using vehicle 12' via a chute (not shown) but can also accommodate a conventional loading bucket 206 from a conventional loader (not shown) in the direction of arrow 207.

The upper section of the comminuting chamber 30 comprising the side walls 33 is outwardly dependent at approximately 17 degrees. Note also that one of the side walls, (viz., the front side wall 33 containing the entry port 34) is slightly curved and is formed of non-abrasive, non-rusting stainless steel to reduce resistance to flow. A side entry port 208 (with disconnectable cover 208*a*) is also available so as to allow quick entry of sticks and small branches material into the chamber 30 since such material would not easily travel through the entry hose 35 without change in operating RPM's of the chamber 30.

Figure 13:
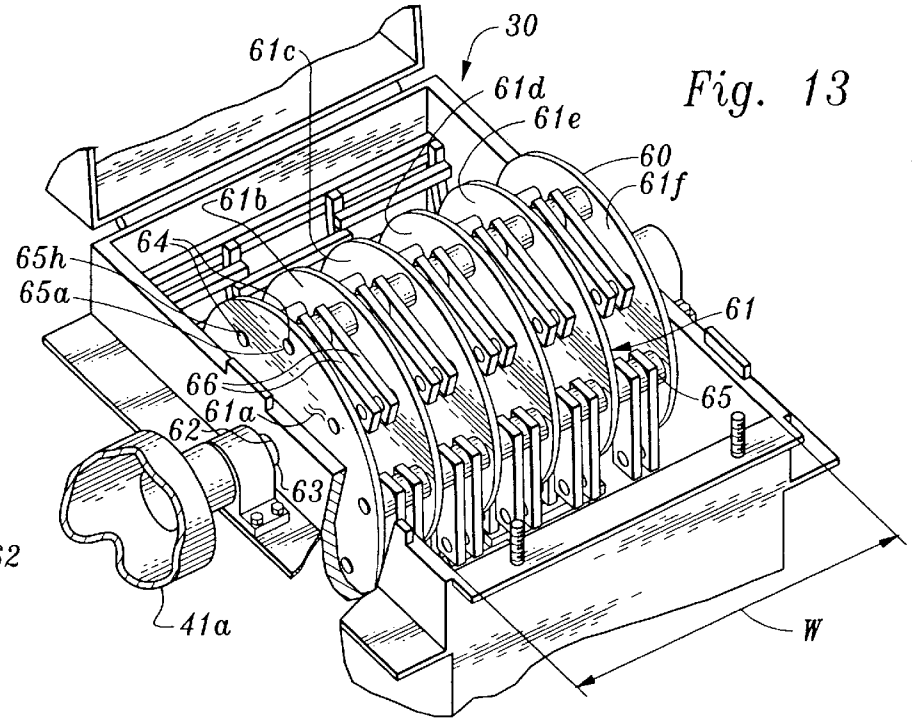
FIG. 13 is a detail perspective view of the shredding assembly of the comminuting chamber of FIGS. 9 and 10.

The shredding assembly 60 includes a series of horizontally stacked discs 61 spaced across the entire width of the chamber 30. Note that the stacked discs 61, see FIG. 13, are provided with central openings 62 for attachment to a central drive shaft 63 and more radially spaced openings 64 through which radial rods 65*a*–65*h* are attached at a common radius R. Hammer support rods 65*a,* 65*c,* 65*e,* 65*g* are equi-spaced about the circumference of the stacked discs 81 and attach to working hammers 66 at attaching ends 66*a* thereof. That is, such hammers 66 rotate relative to the rods 65*a,* 65*c,* 65*e,* 65*g* as does the discs 61 in the direction of arrows 67 to assume the working positions depicted in FIGS. 9–11 in which axes of symmetry 68 define radial positions that intersect at drive shaft 63. As a result, the hammers 66 rotate about the drive shaft 63 as a series of hammer heads that not only pulverize debris that comes within cutting zone 70 but also forces such debris through the grate 69. As a result, debris entering the comminuting chamber 30 via input port 34 is shredded by the shredding assembly 60 and then passes through grate 69 adjacent to floor 72 and thence out of the comminuting chamber 30 via output port 74. Grate 69 can be cleaned of clogged materials caught therein by removing the outlet pipette or hose 75. Thereafter, the debris passes through the pipette 75 connected to the output port 74 of the comminuting chamber 30 and thence into the air vacuum chamber 31. The output port 74 is located at the bottom edge of one of the walls 33 and is circular in cross section.

Air vacuum chamber 31 also has an input port 76 in one of its side walls 77 defining an interior cavity 77*a,* a flywheel 79 positioned within the cavity 77*a* having a central opening 80 fitted with a drive shaft 81 connected to the flywheel 79 via a series of blades 82 radiating at a common angle from the drive shaft 81. Rotation of the flywheel 79 pumps air through output port 83 to provide the various operations previously mentioned, say via the output hose 36 to the canopy bed 11 of the vehicle 12, see FIG. 1 (mode (I)), or say with the output hose 36 disconnected using directional dispersal chute 211 of FIG. 9 to spread materials lateral to the system of the invention (mode (II and III)).

Figure 17:
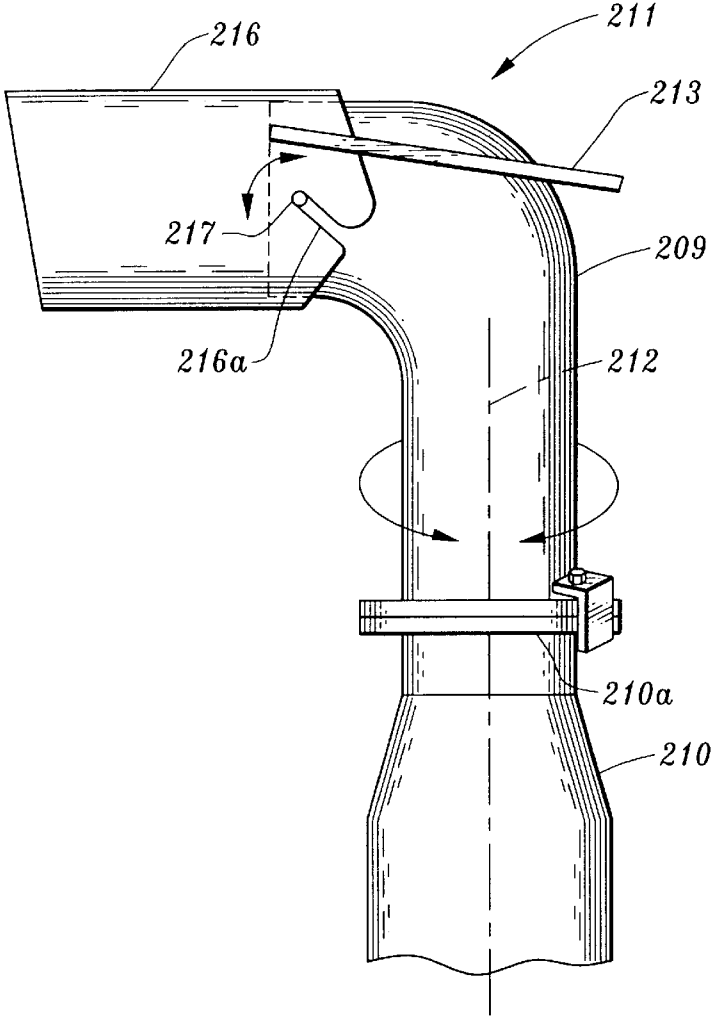
FIG. 17 is a detail side view of the dispersal outlet chute of FIG. 9 including a handle by which a user can manipulate the chute.

FIG. 17 show the dispersal chute 211 in more detail.

Figure 19:
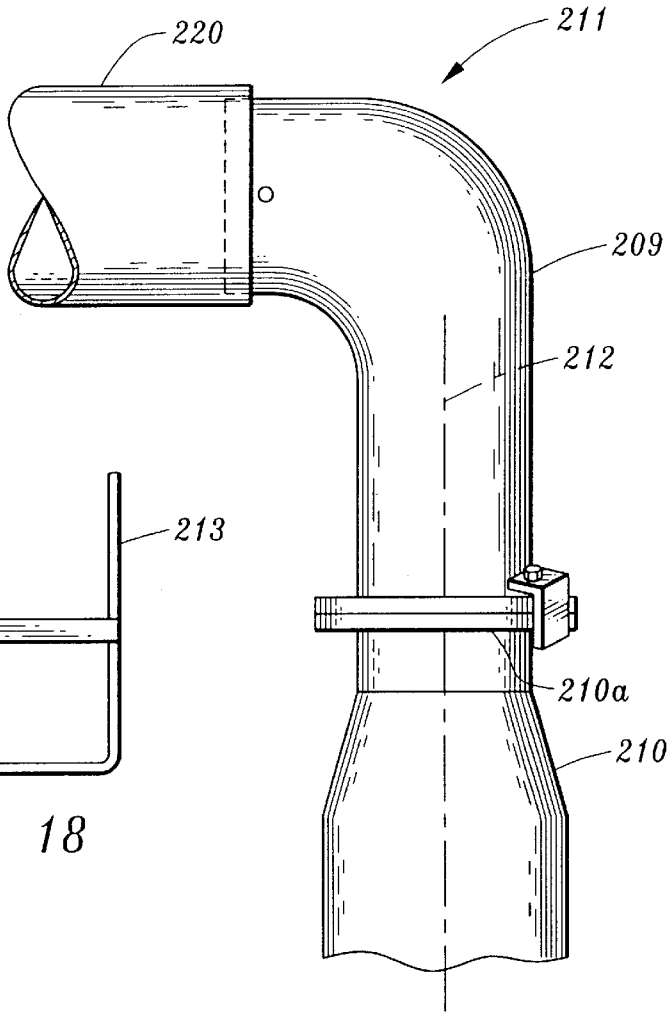
FIG. 19 is a detail view of the dispersal outlet chute of FIG. in another mode of operation in which the dispersal chute is attached to an auxiliary output hose for blowing material to adjacent locations.
Figure 18:
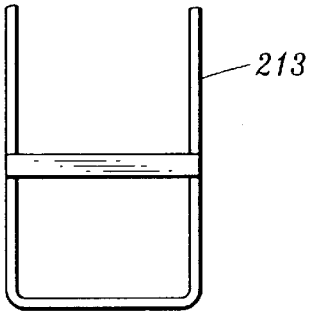
FIG. 18 is a detail top view of the handle of the chute of FIG. 17.

As shown the dispersal chute 211 includes a swedging base pipe 210 that changes the cross section from rectangular to circular and has a flange 210*a* at its upper end which in turn connects to an angled directional outlet 209 pivotal about fixed axis of symmetry 212 of the base pipe 210. The chute 211 includes a handle 213 at attached to an outwardly protecting, directional enhancer 216 of rectangular cross section pivotal mounted via slots 216*a,* to ears 217 attached to the outlet 209. Note that the outlet 209 and enhancer 216, can be pivoted relative to the base pipe 210 a full 360 degrees thereabout and the directional enhancer 216 is pivotal about ears 217 in elevation, whereby the output material to be directionally and elevationally spread at various distances relative to the chute 211 to distances up to 20–50 feet in any direction and modest elevation changes in modes (II and III) of operations, see FIG. 17, or be connected to auxiliary hose 220, see FIG. 19, in mode (IV) operations to convey the material up to 500 feet therefrom.

Figure 16:
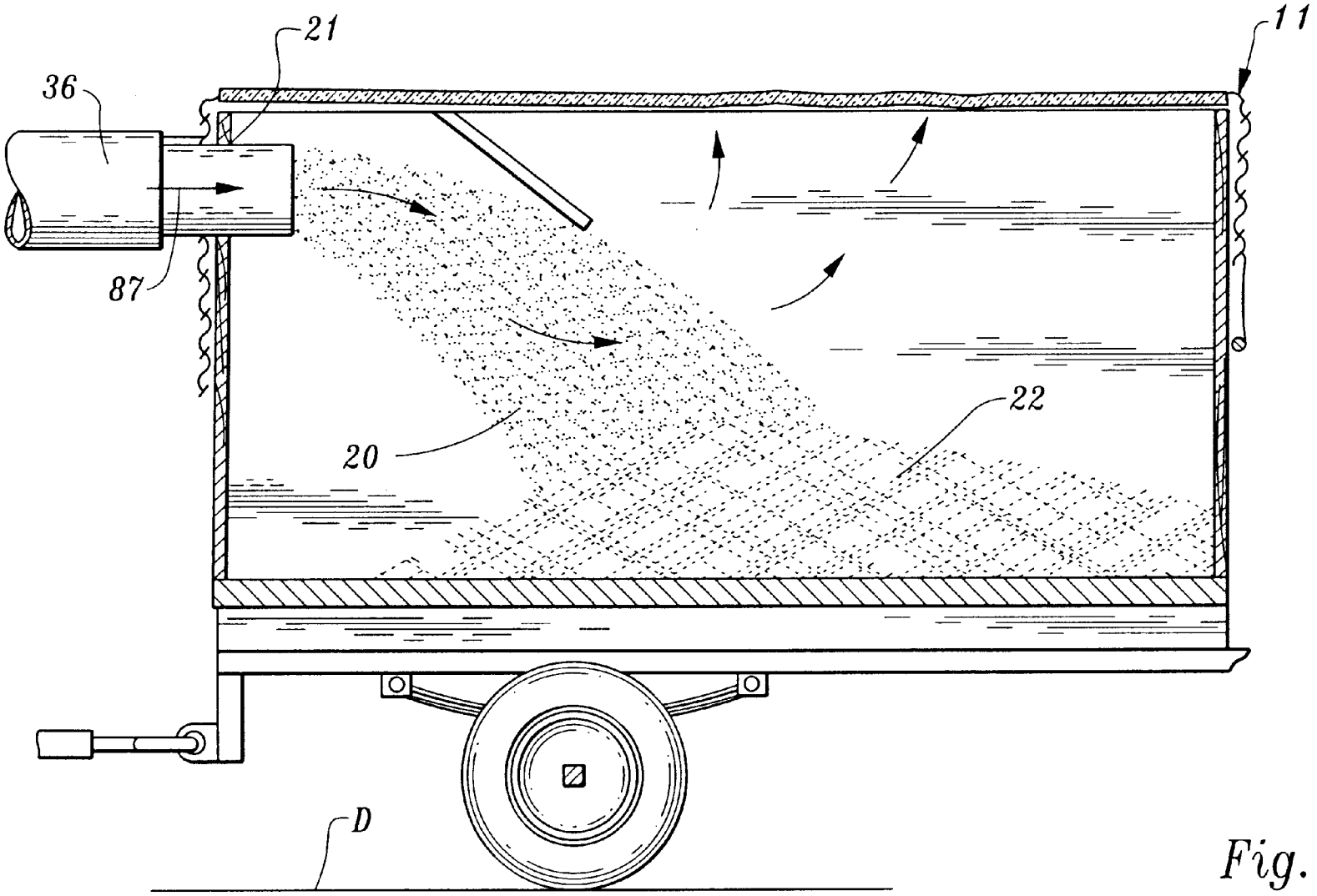
FIG. 16 is a detail side view of the self-propelled vehicle shown in solid line in FIG. 1.

Note in FIG. 9 that the rotation of the flywheel 79 in operations generates flow of air through the system 10 of the invention in a variety of directions, viz., within the comminuting chamber 30 in the direction of arrows 84; in the direction of arrows 85 between the comminuting and air pumping chambers 30, 31; in the direction of arrows 86 in the air pumping chamber 31; and in the direction arrows 87 in the output hose 36, see FIG. 16. The air flow is sufficient to carry debris through all station of the system 10, as explained below, and is aided within the air chamber 31 by placement of liner 200 interior of the cavity 77*a,* see FIG. 9. The liner 200 is formed of an ultra high density plastic of an ultra high molecular weight (UHMW) and provides rapid flow at reduce friction and can be replaced if damaged.

FIG. 4 is a schematic diagram of the motor system 40 showing that the air fan chamber 31 and the comminuting chamber 30 are driven into operations via hydraulic motors 41*a,* 41*b* through hydraulic pump 42 connected the engine 32, on the pressure side. A reservoir tank 38 feeds fluid to the hydraulic pump 42 with the fluid being returned from the hydraulic motors 41*a,* 41*b,* with the fluid from the fan chamber motor 41*b* first passing through cooler 39.

As shown, the hydraulic pump-hydraulic motor system 40 includes separately controllable hydraulic motors 41*a* and 41*b* connected to a hydraulic pump 42 driven by the engine 25. Each motor 41*a*, 41*b* is separately and independently controlled through a controller 183 that directs fluid from the hydraulic pump 42 to impellers on a shaft (not shown) that drives the drive shafts 63, 81 of the comminuting and air chambers 30, 31, respectively to develop power in the range 0–35 h.p and 0–15 h.p., respectively.

Each hydraulic motor 41*a*, 41*b* has a by-pass system (not shown) that prevents the drive shafts 63, 81 of the comminuting and air chambers 30, 31, respectively From generating back pressure as the shafts 63, 81 continued to rotate after hydraulic motors 41*a*, 41*b* are deactivated.

FIG. 4 shows that rotation of drive shafts 63, 81 of the comminuting and air vacuum chambers 30, 31 is a direct function of rotation of drive shaft 91 of the engine 32. Operational characteristics of engine 32: 65–115 h.p. at 1800–3,000 rpm, fuel consumption at 2400 rpm is 2.2–2.5 gph. In addition to on-off controller 36*a* of FIG. 1 and speed controller 37*b,* the engine 32 is directly connected to the hydraulic pump 42. In that way, the speed of the drive shafts 63, 81 of the comminuting and air pumping chambers 30, 31 are directly related to the speed of rotation of the drive shaft 91 of the engine 32.

Where the speed of the drive shaft 91 of the engine 32 is between 6,000 to 11,000 rpm, the hydraulic system 40 provides for variable speeds to be developed for efficient and variable operations of comminuting and air pumping chambers 30, 31, respectively as above described so as to provide smooth total operations.

For example, the air vacuum chamber 31 is engineered based on such speed to provide a range of air flow rates, Q, in a range of 6,000 to 8,000 FPM at 9 inches static pressure to carry the un-shredded debris and materials previously described into the comminuting chamber 30 and thereafter, to carry the same from the comminuting chamber 30 through the air vacuum chamber 31. In addition, the comminuting chamber 30 is provided with distinctive shredding operations because of its stacked design as depicted in detail in the FIGS.

As shown in FIG. 13, the shredding assembly 60 within the comminuting chamber 30 extends across the full width W of the chamber 30. That is, the series of horizontally stacked discs generally indicated at 61 is spaced across the entire width W starting with end discs 61*a,* 61*f* with stabilizing discs 61*b,* 61*c,* 61*d,* 61*e* located therebetween. There are thus multiple sets of working hammers 66 at each station defined by support rods 65*a,* 65*c,* 65*e,* 65*g*, see FIG. 9, so that there are twelve working hammers 66 per each support rod for a total of forty-eight working hammers 66 comprising the shredding assembly 60. Between the support rods 65*a,* 65*c,* 65*e,* 65*g* are a series of stabilizing rods 65*b* . . . 65*f* . . . 65*h* that connect to the end and stabilizing discs 61*a*–61*f*.

Figure 12:
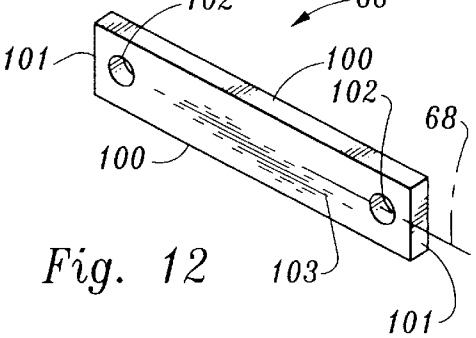
FIG. 12 is a detail perspective view of a hammer of a shredding assembly of the comminuting chamber of FIGS. 9 and 10.

FIG. 12 shows the working hammer 66 in detail.

As shown, each working hammer 66 is of rectangular cross section defining an axis of symmetry 68, side surfaces 100, end surfaces 101 and a pair of openings 102 at each end.

The side and end surfaces 100, 101 initially have sharp edges at their intersection with broad surfaces 103 but as operations continue flatten out due to the hammer head action of each hammer 66. Hence, the debris shredded via pulverizing rather than cutting action. Note that only one of the pair of openings 102 is attached to the support rods 65*a*, 65*c*, 65*e*, 65*g* (see FIGS. 9, 13, 14). However, the design of the hammers 66 allows for more efficient and long-lasting operations, in that each hammer 66 can be reversed in orientation using the other of the pair of openings 102 of FIG. 9 to bring new surfaces into operation.

Figure 15:
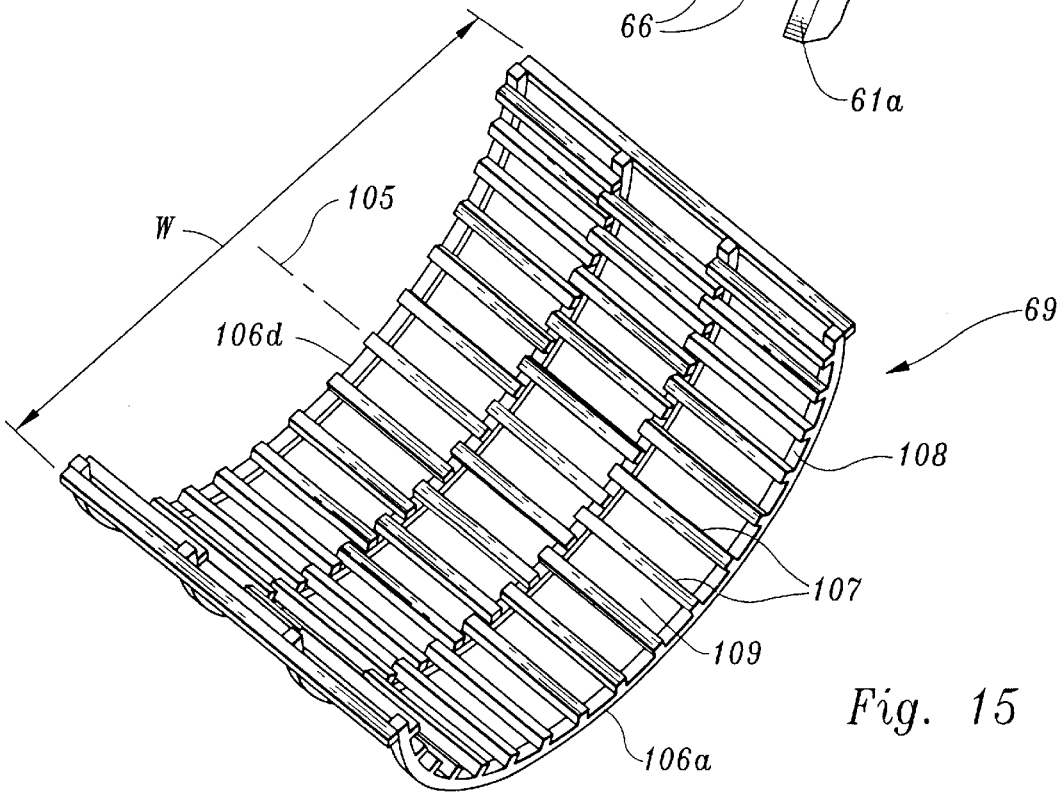
FIG. 15 is a detail perspective view of the grate of the shredding assembly of FIGS. 9 and 10.

FIG. 15 shows grate 69 in more detail.

As shown, the grate 69 is arcuately shaped and defines a width W match to that of the comminuting chamber 30 wherein its axis of formation 105 is centered at the drive shaft 63, see FIG. 9. The grate 69 has a series of curved rails 106*a*–106*d* also defined by center formation 105. In addition, a series of support rails 107 extend across and are in attaching contact with broad surfaces 108 of the curved rails 106*a*–106*d*.

Note that openings 109 defined between neighboring support rails 107 are designed to only permit pulverized rocks to pass therethrough. That is, the width of the openings 109 are about 3 inch. Hence, rocks of greater dimensions are pulverized as are rocks of less dimensions due to the addition of garden debris which tends to keep such rocks in the cutting zone a significant period of time to insure their break-up. However, it should also be noted that in some instances involving manly erosion aversion, it may be desirable to have the size of the openings 109 of the grate 69 changed. To this end, different sized grates 69 can be inserted one at a time. The largest possible size or grade of end product is achieved by omitting the grate 69 altogether.

METHOD ASPECTS

While the system 10 of FIG. 1 is most conveniently operated in association with the vacuum hose 35 of FIG. 2 in modes (I), (II), (III) and (IV), there are other forms of inputting debris into the system 10, such as by conveyor or dump truck. That is to say, although the invention has been illustrated and described with respect to exemplary embedments thereof, it should be understood by those skilled in the art that various changes, omissions, modifications and additions may be made without departing from the spirit of the invention.

We claim:

1. A hydraulic assisted comminuting, vacuuming and spreading and/or loading system for debris that can contain small rocks, lawn clippings, leaves, plants, native materials, duff from forest floors, straw, pine needles, chipper chips, chunks of wood processed by chippers captured on-site or trucked-in, commercial mulch, comprising:

a self propelled vehicle having remote and near ends, ground engaging means in contact with the earth's surface to establish a datum line, said self propelled vehicle including a bed at said remote end;

a frame trailerable attached to to one of said remote and near ends of said self propelled vehicle, said frame including first and second ends, ground engaging wheels in contact with the earth' surface at said datum line;

a comminuting chamber attached to said frame at one of said first and seconds ends and having a plurality of side walls upwardly depending from said frame and including sets of independently servicing input openings for inputting debris interior of the comminuting chamber and an output opening, said chamber including a hammermill comprising disc means located within the side walls having a shaft extending across said chamber, a first hydraulic motor attached at one end of said shaft, a first controller operatively attached to said first hydraulic motor for controlling independent operation thereof, said hammermill including a series of bifurcated hammers attached to said disc means and movable therewith, and a disconnectably connected grate at the periphery of said disc means through which comminuted material passes;

a first conduit means disconnectably connected to said output opening of said comminuting chamber to convey said comminuted material therethrough, and connectably disconnected therefrom to permit materials other said comminuted material to be conveyed therethrough independent of said comminuting chamber, an air fan chamber attached to said frame and having an input opening attached to said first conduit means, an output opening horizontally positioned at a position above said datum line, a fan positioned within said chamber including a flywheel having a shaft, a second hydraulic motor attached at said shaft, a second controller operatively attached to said second hydraulic motor for controlling independent operation thereof, a directional dispersal means having an input pivotally connected to said output opening of said air fan chamber at said position above said datum line, and an output end also positioned above said datum line, a second conduit means disconnectably connected to said directional dispersal means to deliver said comminuted material to said vehicle in a first mode of operation and connectably disconnected therefrom in a second mode of operation whereby one of (i) materials other than said comminuted material and (ii) said comminuted material existing from said air fan chamber is propelled long distances off-set to said self propelled vehicle for ecological purposes by said directional dispersal means, a hydrocarbon sourced engine, mounted to said frame having a drive shaft rotating in a specified range, a hydraulic pump attached to said drive shaft of said engine and providing independent hydraulic sourcing of said first and second hydraulic motors to provide independently controlled rotation of said hammermill and said fan positioned within the comminuting and air fan chambers, respectively, to drive one of (i) said materials other than comminuted material and (ii) said comminuted material exiting from said air fan chamber at a flow rate Q through at least said air vacuum generating chamber, thence from the air fan chamber where Q is a high rate.

2. The system of claim 1 in which said dispersal means includes a base connected to said output opening of said air fan chamber, an angled outlet pivotally connected to said base and including a side wall, said output end and a pair of ears cantilevering exterior of said side wall.

3. The system of claim 2 in which said direction dispersal means includes a directional enhancer disconnectable connected to said pair of ears in said second mode of operation and connectively disconnected therefrom in said first mode of operation.

4. The system of claim 1 in which the debris to be processed contains rocks up to 3 inches in diameter.

5. The system of claim 1 in which the specified range of rotation of said drive shaft of said hydrocarbon sourced engine is from 1800 to 3000 rpm.

6. The system of claim 1 with the addition of a water carrying conduit having an end opening positioned to wet said debris prior to entry into said comminuting chamber, a reservoir of water carried on said frame connected to said conduit, and a ON-OFF valve attached to said conduit for wetting said debris prior to entry into said comminuting chamber sufficient to reduce generation of air-born dust and associated debris.

7. The system of claim 1 in which flow rate Q is in range of 6,000 to 11,000 cfm at 9 inches static pressure.

8. A hydraulic assisted comminuting, vacuuming and spreading and/or loading system for debris, comprising a self propelled vehicle in contact with the earth's surface to establish a datum line and including a bed;

a frame trailerable attached to said self propelled vehicle including ground engaging wheels;

a comminuting chamber attached to said frame having a plurality of side walls upwardly depending from said frame, sets of independently servicing input openings for inputting debris interior of said comminuting chamber and an output opening through said side walls for outputting comminuted material, said chamber including a hammermill having a shaft extending across said chamber, a first hydraulic motor attached to said shaft, a first controller operatively attached to said first hydraulic motor for controlling independent operation thereof;

a first conduit means disconnectably connected to said output opening of said comminuting chamber to convey comminuted material therethrough, and connectably disconnected therefrom to permit materials other than comminuted material to be conveyed therethrough independent of said comminuting chamber, an air fan chamber attached to said frame having an input opening attached to said first conduit means, and an output opening horizontally positioned at a position above said datum line, a fan positioned within said chamber including a shaft, a second hydraulic motor attached at said shaft, a second controller operatively attached to said second hydraulic motor for independent operation thereof, a directional dispersal means having an input pivotally connected to said output opening of said air fan chamber at said position above said datum line, and an output end also positioned above said datum line, a second conduit means disconnectably connected to said output end of said directional dispersal means to deliver said comminuted material to said bed of said vehicle in a first mode of operation and connectable disconnected therefrom in a second mode of operation whereby one of (i) said materials other than said comminuted material and (ii) said comminuted material existing from said air fan chamber is propelled long distances off-set to said self propelled vehicle for ecological purposes by said directional dispersal means independent of said second conduit means, a hydrocarbon sourced engine, mounted to said frame having a drive shaft rotating in a specified range, a hydraulic pump attached to said drive shaft of said engine and providing independent hydraulic sourcing of said first and second hydraulic motors to provide independently controlled rotation of said hammermill and said fan positioned within said comminuting and air far chambers, respectively, to drive one of (i) materials other than said comminuted material and (ii) said comminuted material exiting from said air fan chamber at a flow rate Q where Q is a high rate.

9. The system of claim 8 in which said dispersal means includes a base connected to said output opening of said air fan chamber, an angled outlet pivotally connected to said base and including a side wall, said output end and a pair of exterior ears cantilevering from said side wall.

10. The system of claim 9 in which said direction dispersal means includes a directional enhancer disconnectable connected to said pair of ears in said second mode of operation and disconnected therefrom in said first mode of operation.

11. The system of claim 8 in which the debris to be processed can contain small rocks up to 3 inches in diameter, be lawn clippings, leaves, plants and the like, be native materials such as duff from forest floors, straw, pine needles, chipper chips (chunks of wood processed by a chipper (bladed apparatus) captured on-site or trucked-in, commercial mulch and the like that can be wetted to a slight degree.

12. The system of claim 8 in which the specified range of rotation of said drive shaft of said hydrocarbon sourced engine is from 1800 to 3000 rpm.

13. The system of claim 8 with the addition of a water carrying conduit having an end opening positioned to wet said debris prior to entry into said comminuting chamber, a reservoir of water carried on said frame connected to said conduit, and a ON-OFF valve attached to said conduit for wetting said debris prior to entry into said comminuting chamber sufficient to reduce generation of air-born dust and associated debris.

14. The system of claim 8 in which flow rate Q is in a range of 6,000 to 11,000 cfm at 9 inches static pressure.

15. A hydraulic assisted comminuting, vacuuming and spreading and/or loading system for debris, comprising a self propelled vehicle in contact with the earth's surface to establish a datum line;

a frame trailerable attached to said self propelled vehicle and including ground engaging wheels at said datum line;

a comminuting chamber attached to said frame having a plurality of side walls upwardly depending from said frame, sets of independently servicing input openings for inputting debris interior of said comminuting chamber, and an output opening through said side walls for outputting comminuted material, said chamber including a hammermill located within said side walls, a first hydraulic motor operatively attached to said hammermill, a first controller operatively attached to said first hydraulic motor for controlling independent operation thereof, a first conduit means disconnectably connected to said output, opening of said comminuting chamber to convey comminuted material therethrough, and connectably disconnected therefrom to permit materials other than comminuted material to be conveyed therethrough independent of said comminuting chamber, an air fan chamber attached to said frame having an input opening attached to said first conduit means, and an output opening horizontally positioned at a position above said datum line, a fan positioned within said chamber, a second hydraulic motor attached at said fan, a second controller operatively attached to said second hydraulic motor for independent operation thereof, a directional dispersal means having an input pivotally connected to said output opening of said air fan chamber at said position above said datum line, and an output end also positioned above said datum line, a second conduit means disconnectably connected to said directional dispersal means to deliver enhanced, comminuted material to said bed of said vehicle in a first mode of operation and connectably disconnected therefrom in a second mode of operation whereby one of (i) materials other than said comminuted material and (ii) comminuted material exiting from said air fan chamber is propelled long distances off-set to said self propelled vehicle for ecological purposes by said directional dispersal means independent of said second conduit means, a hydrocarbon sourced engine, mounted to said frame having a drive shaft rotating in a specified range, a hydraulic pump attached to said drive shaft of said engine and providing independent hydraulic sourcing of said first and second hydraulic motors to provide independently controlled rotation of said hammermill and said fan positioned within said comminuting and air fan chambers, respectively, to direct one of (i) said materials other said comminuted material and (ii) said comminuted material exiting from said air fan chamber at a flow rate Q, where Q is a high rate.

16. The system of claim 15 in which said dispersal means includes a base connected to said output opening of said air fan chamber, an angled outlet pivotally connected to said base and including a side wall, said output end and a pair of exterior ears cantilevering from said side wall adjacent to said output end.

17. The system of claim 16 in which said direction dispersal means includes a directional enhancer disconnectably connected to said pair of ears adjacent to said output end in said second mode of operation wherein said second conduit means is connectively disconnected from said output end, whereby said directional enhancer directs delivery of said one of (i) said materials other than said comminuted material and (ii) said comminuted material, existing from said air fan chamber, long distances offset to said self propelled vehicle for ecological purposes, said directional enhancer being connectively disconnected from said pair of ears in said first mode of operation and disconnectably connected thereto in said second mode of operation.

* * * * *